US008840188B2

(12) United States Patent
Diffrient et al.

(10) Patent No.: US 8,840,188 B2
(45) Date of Patent: Sep. 23, 2014

(54) MOVABLE ARM PAD

(75) Inventors: Niels Diffrient, Ridgefield, CT (US); Emilian D. Cartis, Brooklyn, NY (US); Mark McKenna, New York, NY (US); Steven Remy, New York, NY (US)

(73) Assignee: Humanscale Corporation, New York, NY (US)

( * ) Notice: Subject to any disclaimer, the term of this patent is extended or adjusted under 35 U.S.C. 154(b) by 321 days.

(21) Appl. No.: 13/361,834

(22) Filed: Jan. 30, 2012

(65) Prior Publication Data

US 2012/0145840 A1 Jun. 14, 2012

Related U.S. Application Data

(60) Continuation-in-part of application No. 12/173,952, filed on Jul. 16, 2008, now Pat. No. 8,104,837, which is a division of application No. 11/173,874, filed on Jul. 1, 2005, now Pat. No. 7,581,791.

(60) Provisional application No. 60/586,114, filed on Jul. 7, 2004.

(51) Int. Cl.
*A47C 1/03* (2006.01)
*A47C 7/54* (2006.01)

(52) U.S. Cl.
CPC .... *A47C 1/03* (2013.01); *A47C 7/54* (2013.01)
USPC ..... 297/411.37; 297/411.31

(58) Field of Classification Search
CPC ..... A47C 1/03; A47C 7/54
USPC ..... 297/411.31, 411.32, 411.37
See application file for complete search history.

(56) References Cited

U.S. PATENT DOCUMENTS

| | | | |
|---|---|---|---|
| 213,775 | A | 4/1879 | Redman et al. |
| 2,274,223 | A | 3/1883 | Redman |
| 1,050,672 | A | 1/1913 | MacIntosh |
| 1,139,581 | A | 5/1915 | Riley |
| 4,244,623 | A | 1/1981 | Hall et al. |
| 4,307,913 | A | 12/1981 | Spiegelhoff |
| 4,311,338 | A | 1/1982 | Moorhouse |
| 4,946,226 | A | 8/1990 | Hurn et al. |
| 5,895,095 | A | 4/1999 | Chen |

(Continued)

FOREIGN PATENT DOCUMENTS

| | | |
|---|---|---|
| EP | 1057428 | 12/2000 |
| WO | 03/068025 | 8/2003 |
| WO | 2006/017065 | 2/2006 |

OTHER PUBLICATIONS

International Preliminary Report on Patentability on PCT/US2005/023768 issued by the European Patent Office as International Preliminary Examining Authority on Mar. 2, 2007.

(Continued)

*Primary Examiner* — Anthony D Barfield
(74) *Attorney, Agent, or Firm* — Jones Walker, LLP

(57) ABSTRACT

Horizontally movable arm pads are useful for, among other things, their ability to be ergonomically positioned. An arm pad comprises a pad cover and a pad pan and is attached to an arm support. In one embodiment, a pad is laterally movable with respect to the arm support. In another embodiment, a pad is capable of moving forwards and backwards. In yet another embodiment, a pad is capable of moving laterally and forwards and backwards.

20 Claims, 22 Drawing Sheets

(56) References Cited

U.S. PATENT DOCUMENTS

| | | | |
|---|---|---|---|
| 6,017,091 | A | 1/2000 | Cao |
| 6,176,550 | B1 | 1/2001 | Lamart et al. |
| 6,619,746 | B2 | 9/2003 | Roslund, Jr. et al. |
| 6,702,386 | B2 | 3/2004 | Davis et al. |
| 6,709,058 | B1 | 3/2004 | Diffrient |
| 6,959,965 | B2 | 11/2005 | Diffrient |
| 7,581,791 | B2 | 9/2009 | Diffrient |
| 8,104,837 | B2 | 1/2012 | Diffrient |
| 8,496,295 | B2 * | 7/2013 | Chen ..... 297/411.37 |
| 2002/0149247 | A1 | 10/2002 | Diffrient |
| 2003/0030317 | A1 | 2/2003 | Chen |
| 2006/0006723 | A1 | 1/2006 | Diffrient |
| 2009/0302661 | A1 | 12/2009 | Melhuish et al. |

OTHER PUBLICATIONS

PCT/US2005/023768:EPO as International Search Authority, written opinion issued Jan. 7, 2007.

* cited by examiner

MOVABLE ARM PAD

CROSS-REFERENCES TO RELATED APPLICATIONS

This application is a continuation-in-part of application Ser. No. 12/173,952, filed on Jul. 16, 2008 now U.S. Pat. No. 8,104,837, which is a division of application Ser. No. 11/173,874, filed on Jul. 1, 2005 now U.S. Pat. No. 7,581,791, which claims the benefit of U.S. Provisional Application No. 60/586,114, filed on Jul. 7, 2004. All of these applications are hereby incorporated by reference.

BACKGROUND

This disclosure relates to limb supports generally, to chair armrests specifically, and to ergonomic arm pads in particular. Horizontally movable arm pads are more preferable than stationary ones in part because they are adjustable to fit a user's desired supporting position. A horizontally movable armrest may be attached to an arm support through one or more slot tracks that permit the arm pad to move laterally. When independently actuable fasteners are inserted through the slot tracks to attach the arm pad to the arm support, the movement of the arm pad is bound by the edges of the slot tracks. In other words, the slot tracks guide the movement of the arm pad. As a user attempts to position the arm pad, such configurations can lead to misfunctioning, abrupt movement, or even an unintentionally locked arm pad because the fasteners are not cooperating and the fasteners knock along the edges of the slot tracks.

SUMMARY OF ILLUSTRATIVE EMBODIMENTS

The following presents a simplified summary of the subject matter of this disclosure in order to provide a basic understanding of some aspects of illustrative embodiments of the invention. This summary is not an exhaustive overview of the details of these embodiments. Nor is this summary intended to identify key or critical elements of the invention or to delineate the scope of the invention. Its sole purpose is to present some concepts in a simplified form as a prelude to the more detailed description that is discussed later.

In one embodiment, an arm pad is movable in a substantially horizontal plane relative to a chair's arm support. One arm pad embodiment is laterally movable, i.e., from left-to-right and right-to-left. In another embodiment, an arm pad is movable forwards and backwards. In another embodiment, an arm pad is movable laterally, forwards, and backwards.

In another embodiment, an arm pad, comprising at least one slot, is laterally movable relative to an arm support. At least one linking member is pivotally attached to the arm pad and is rotatably attached to the arm support. In another embodiment, two linking members are pivotally attached to the arm pad and rotatably attached to the arm support. Each linking member attaches to the arm support through a separate slot in the arm pad. The linking members cooperate in tandem to move the arm pad laterally, thereby promoting fluid movement of the arm pad and avoiding knocking along the edges of the slot tracks or unintentional locking. In one embodiment, the linking members are substantially free of contact with the arm pad slots as the pad moves laterally, at least in-between the rightmost and leftmost positions of the pad. In another embodiment, the linking members are pivotally attached. In another embodiment, the linking members are pivotally attached and the pivotal attachment causes the linking members to cooperate in tandem.

In one embodiment, an armrest comprises an underlying member and an arm pad, which in turn comprises a slot. A first link and a second link are pivotally attached to the arm pad. The links are also pivotally attached to each other by a link connecting member, which further attaches the links to the underlying member through the slot. In another embodiment, an armrest comprises an underlying member and an arm pad, which does not comprise a slot. A first link and a second link are pivotally attached to the underside of the arm pad and to each other. Each link is further pivotally attached to the underlying member.

With the objects of the invention in view, there is also provided a laterally movable armrest including a first link and a second link, each having a first end, a second end and an attachment member. The armrest includes a pan having a first slot and a second slot formed through the pan and a pan support member. The first end of the first link is pivotally attached to the pan and the second end of the second link is pivotally attached to the pan. The second end of the first link and the first end of the second link are pivotally attached to each other such that the first link and the second link are cooperatively movable. The first link attachment member extends through the first slot and attaches to the pan support member. The second link attachment member extends though the second slot and attaches to the pan support member. The first and second slots are shaped to provide non-guiding clearance for movement of the respective first and second link attachment members through the first and second slots.

With the objects of the invention in view, there is further provided an armrest having: a pan including a first slot and a second slot; a pan support member; a first link and a second link cooperatively movable and pivotally attached to each other, each of which is pivotally attached to the pan; and first and second attachment members attaching the respective first and second links to the pan support member through the respective first and second slots.

In accordance with a further feature of the invention, at least one of the first link and the second link includes at least one aperture.

In accordance with an added feature of the invention, the at least one aperture is an elliptic aperture.

In accordance with an additional feature of the invention, one of the first link and the second link is pivotally attached to at least one of the pan and the other link about the at least one aperture.

In accordance with yet another feature of the invention, at least one of the first slot and the second slot has an arc shape.

In accordance with yet a further feature of the invention, the pan further includes a first recess offset around the first slot and a second recess offset around the second slot.

In accordance with yet an added feature of the invention, the pan includes a third recess located between the first and second recesses, the pivotal attachment between the first and second links being operable to move within the third recess.

In accordance with yet an additional further feature of the invention, each of the first and second slots is shaped to provide non-guiding clearance for movement of the respective first and second attachment members through the first and second slots.

In accordance with again a further feature of the invention, each of the first and second links has a rightmost position and a leftmost position and the pan further includes at least one link stop positioned on the pan to abut one of the first link and the second link at one of the rightmost position and the leftmost position.

In accordance with again an added feature of the invention, the pan support member further includes a plate in resistive contact with the pan.

In accordance with again an additional feature of the invention, there is provided at least one bushing in resistive contact with one of the first recess and the second recess and a biasing member urging the at least one bushing to increase its resistive contact with the recess.

In accordance with still another feature of the invention, at least one of the first and second links has a bend.

In accordance with still a further feature of the invention, the pan support member includes a rail and at least one carriage slidably engaged with the rail, wherein the first and second attachment members are operably connected to the at least one carriage to slide the pan in a forward and a backward direction relative to the pan support member.

With the objects of the invention in view, there is also provided an armrest including a pad supported by and movable relative to an underlying object. The armrest includes first and second elongated members pivotally attached to the pad and the underlying object. The first and second elongated members are pivotally attached to each other.

In accordance with a further feature of the invention, the pad has first and second slots formed therethrough and each of the first and second elongated members has an attachment member pivotally attaching the first and second elongated members to the underlying object through the respective first and second slots.

In accordance with an added feature of the invention, the underlying object includes a pad support member having a rail longitudinally disposed within the pad support member, the rail defining a longitudinal axis. At least one carriage is slidably engaged with the rail along the longitudinal axis. At least one of the attachment members is operably connected to the at least one carriage to slide the pad in a direction substantially parallel to the longitudinal axis.

In accordance with again another of the invention, the first elongated member has first and second elliptically shaped apertures, the first elongated member being pivotally attached to the pad about the first elliptically shaped aperture and pivotally attached to the second elongated member about the second elliptically shaped aperture.

In accordance with still an additional feature of the invention, the first and second slots are shaped to provide non-guiding clearance for movement of the attachment members therethrough.

In accordance with a concomitant feature of the invention, at least one of the first and second slots has an arc shape and the pad further includes a first recess offset around the first slot and a second recess offset around the second slot.

BRIEF DESCRIPTION OF THE SEVERAL VIEWS OF THE DRAWINGS

The accompanying figures and detailed description exemplify illustrative embodiments of the invention, denoting like features with like reference numerals, in which.

The figures are not necessarily drawn to scale.

DETAILED DESCRIPTION OF ILLUSTRATIVE EMBODIMENTS

Illustrative embodiments of the invention are described below. In the interest of clarity, not all features of an actual implementation, e.g., dimensions, tolerances, etc., are described in this specification. It will be appreciated that in the development of any such actual embodiment, numerous implementation-specific decisions must be made to achieve the developer's specific goals, such as compliance with manufacturing and business-related constraints, that will vary from one implementation to another. Moreover, it will be appreciated that such a development effort may be complex and time-consuming, but would nevertheless be a routine undertaking for those of ordinary skill in the art having the benefit of this disclosure.

Illustrative embodiments of the invention are described with reference to the accompanying figures. Unless a special definition of a word or phrase is expressly set out in the specification in a definitional manner that directly and unequivocally provides the special definition for the word or phrase, the words and phrases used in this disclosure should be interpreted to have a meaning consistent with the understanding of those words and phrases by those of ordinary skill in the chair arm art. The remainder of this paragraph consists of definitional statements. An embodiment comprising a singular element does not disclaim plural embodiments; i.e., the indefinite articles "a" and "an" carry either a singular or plural meaning and a later reference to the same element reflects the same potential plurality. A structural element that is embodied by a single component or unitary structure may be composed of multiple components. A pad support, support member, and supporting member are used interchangeably and to be construed broadly to include a platform, an armrest base, or other arm support. An underlying object is to be construed broadly to encompass any component part of a chair, bench, or other seating device. Resistive contact is contact that is operable for creating a non-negligible friction force. Unless reference is made to the top or bottom of a figure, directional or positional relationships, such as front, rear, right, left, lateral, inner, outer, over, and under, are determined with respect to the pad from the point of view of a user sitting in a chair with a right-handed armrest. Ordinal designations, on the other hand, merely serve as a shorthand reference for different components and do not denote any sequential, spatial, or positional relationship between them. Like numbers refer to like elements throughout.

Figure 1:
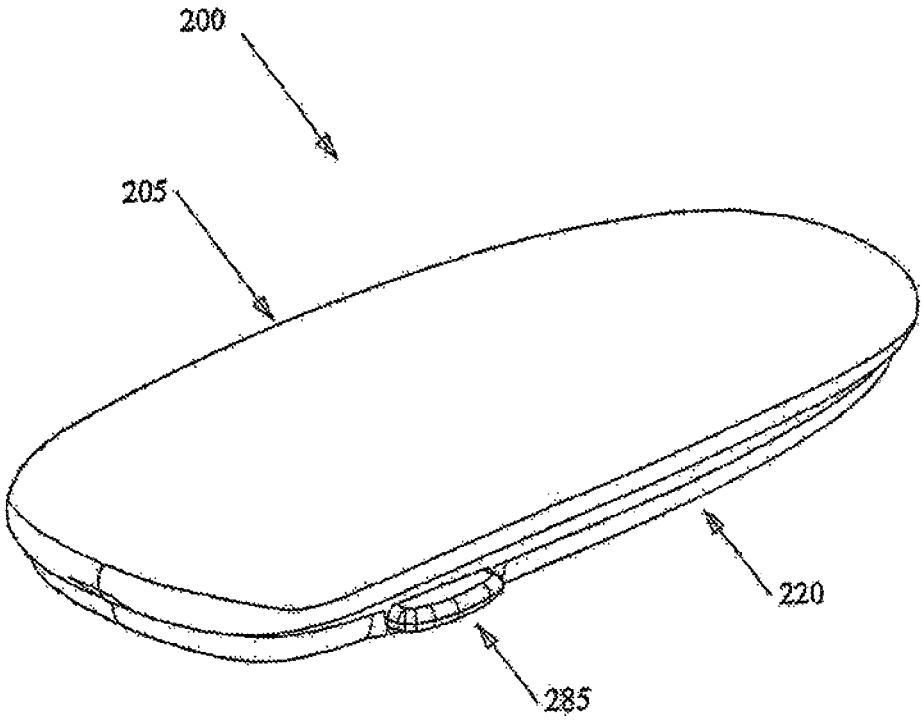
FIG. 1 shows a perspective view of one illustrative embodiment of an arm pad assembly.
Figure 2A:
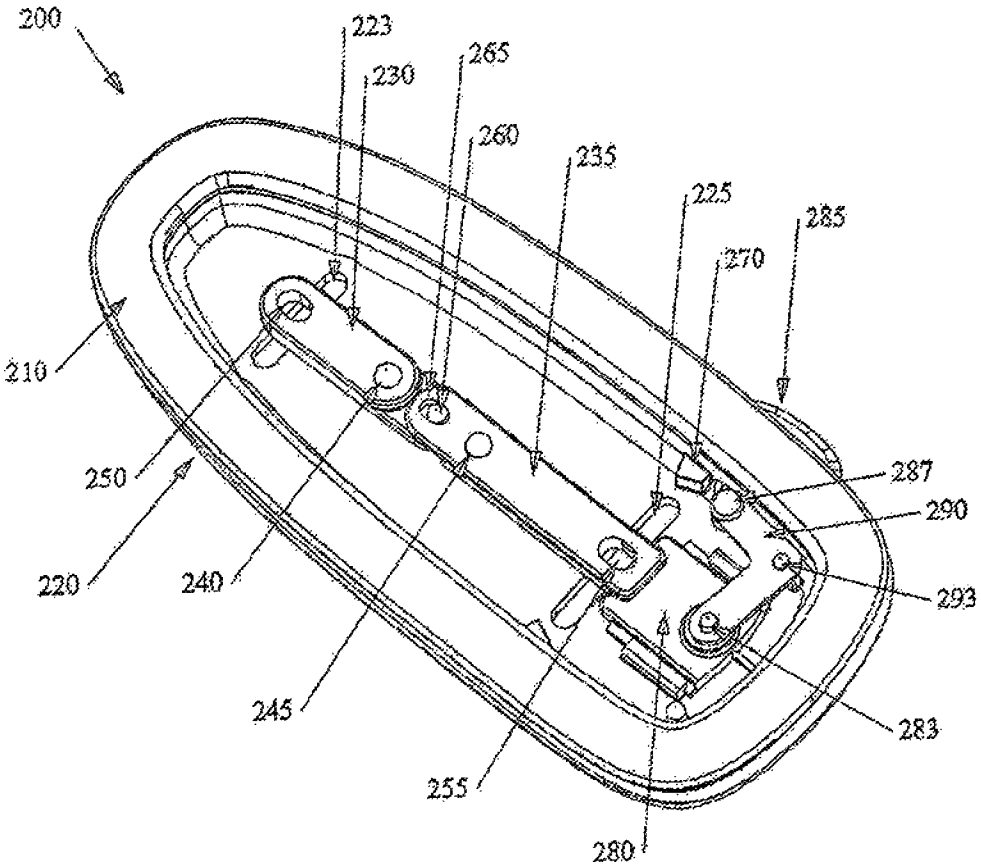
FIG. 2A shows a perspective view of the arm pad assembly of FIG. 1.

In one embodiment, FIG. 1 shows a right-handed arm pad assembly 200. The arm pad assembly 200 comprises an arm pad covering 205, an arm pad pan 220, and a link lock release button 285. Turning to FIGS. 2 and 3, the arm pad assembly 200 is shown with the pad covering 205 removed. The arm pad pan 220 comprises: an arm pad ring 210, a first slot 225, a second slot 223, an inner link stop 270, an outer link stop 275, and a lock slide 280. The lock slide 280 comprises lock slide fingers 295, and lock slide 280 is operably engaged to the link lock release button 285 by an actuating crank 290. The actuating crank 290 is pivotally attached to: the link lock release button 285 by a button pin 287; the arm pad pan 220 by a crank pivot 293; and the lock slide 280 by a lock slide pin 283.

Figure 2B:
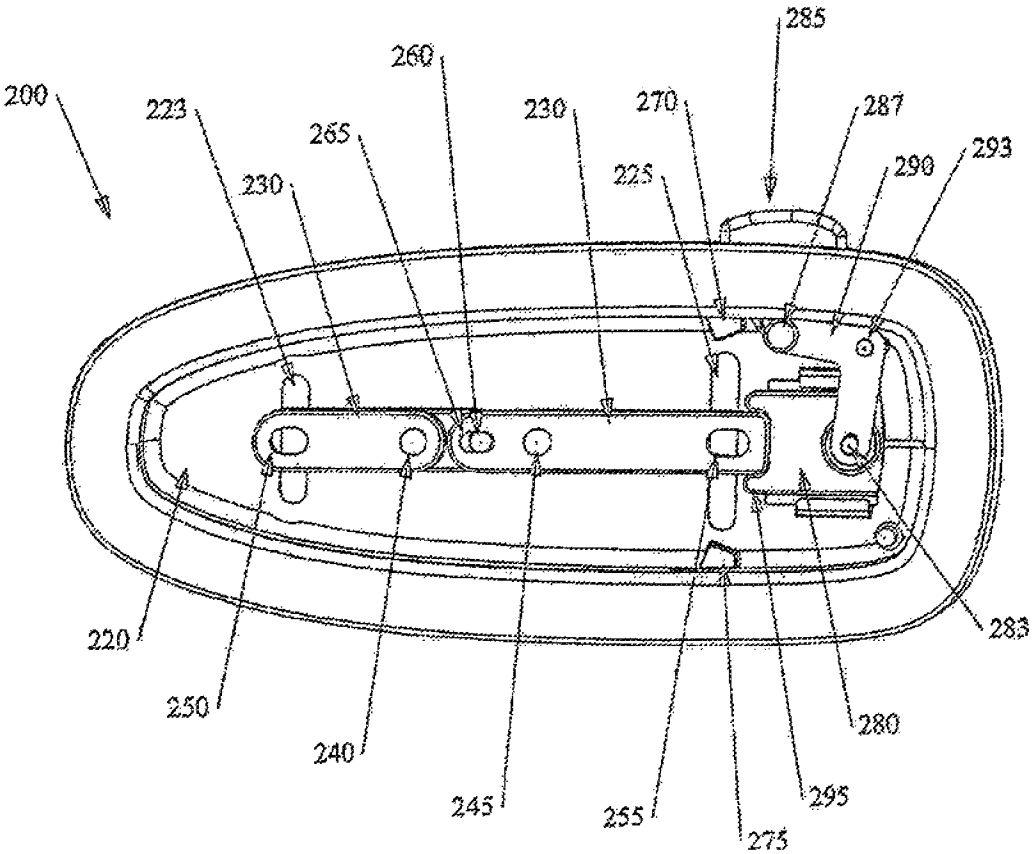
FIG. 2B shows a top elevation view of the arm pad assembly of FIG. 1.
Figure 3A:
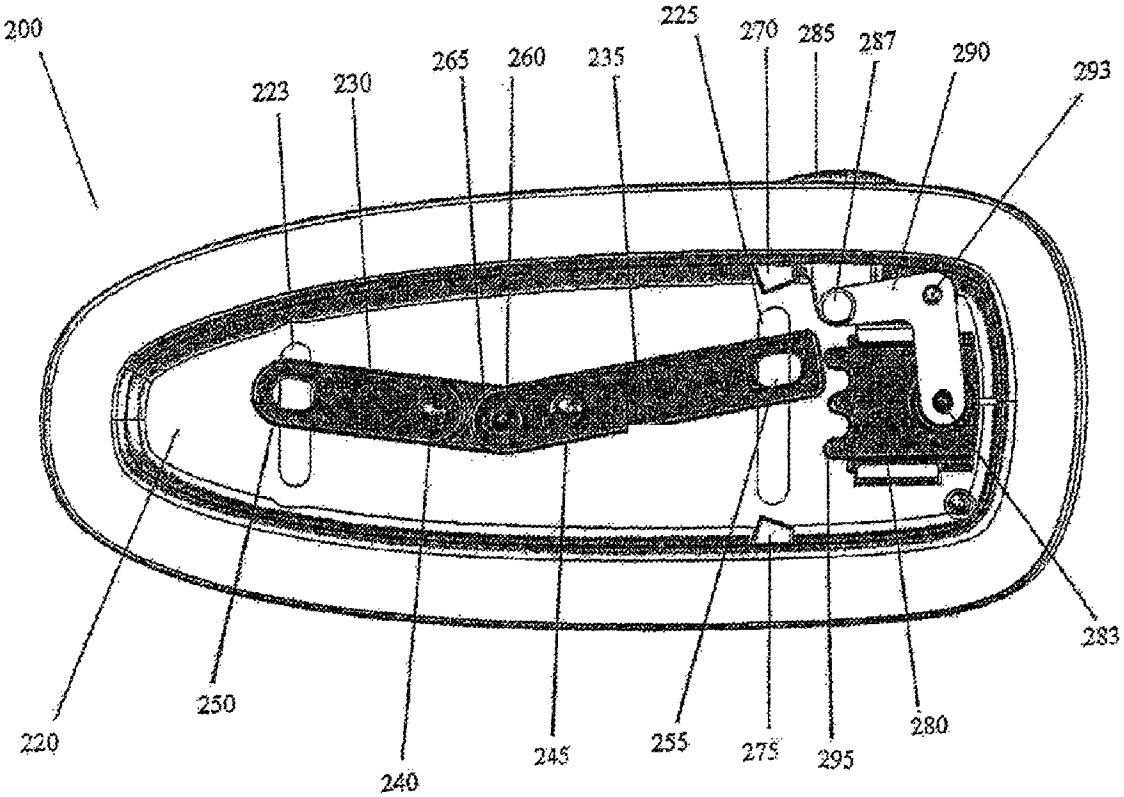
FIG. 3A shows a top elevation view of an illustrative embodiment of an arm pad assembly.
Figure 3B:
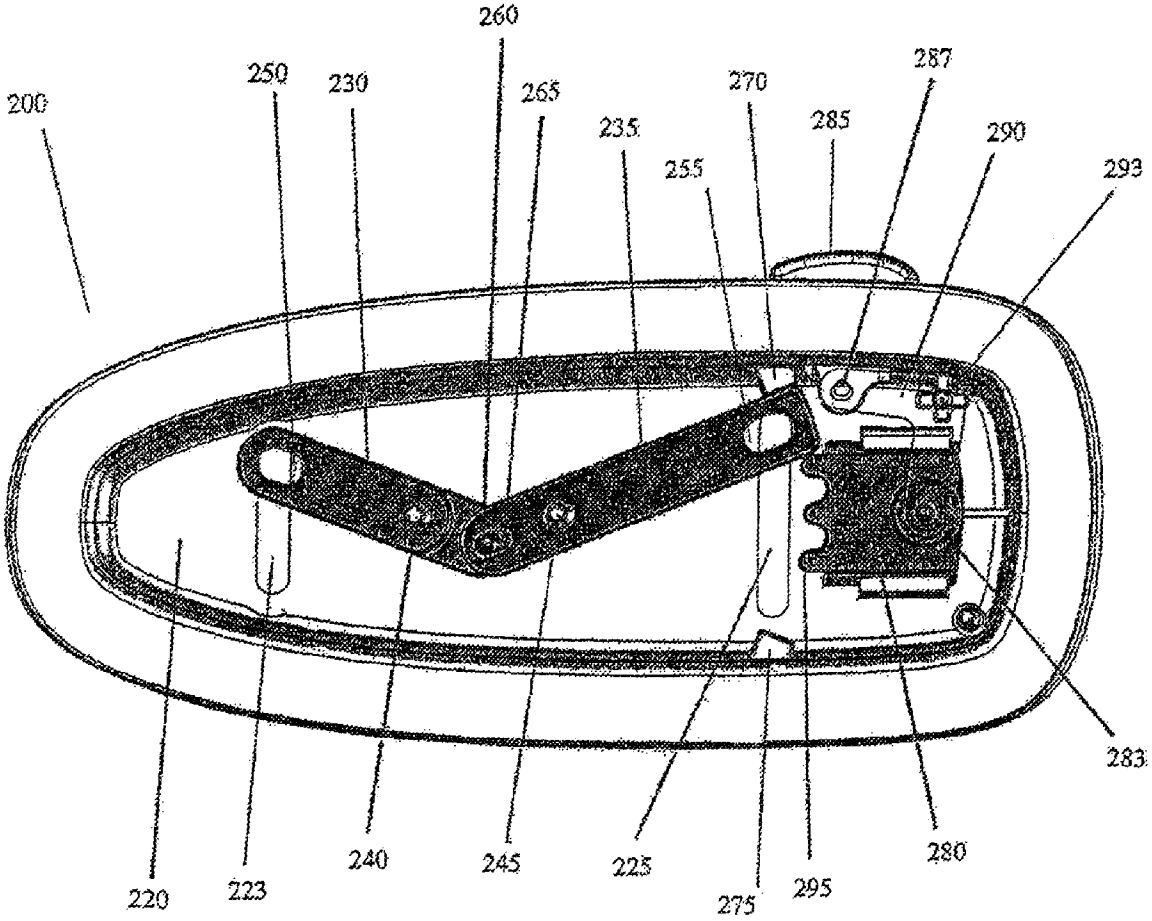
FIG. 3B shows a top elevation view of the arm pad assembly of FIG. 3A.
Figure 4:
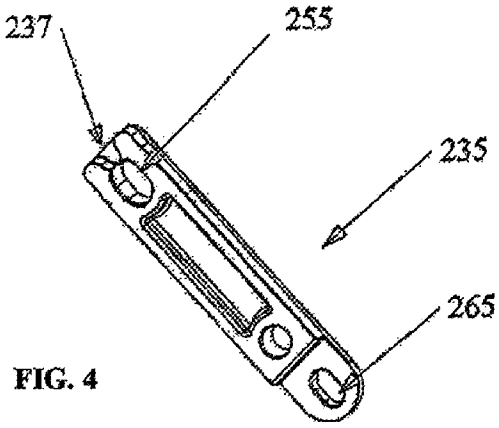
FIG. 4 shows an embodiment of a front link.

In one embodiment, as shown in FIGS. 2A, 2B, 3A, and 3B, a pad 308 comprises an arm pad pan 220, which in turn comprises a first slot 225 and a second slot 223. A first link 235 is pivotally attached to the arm pad pan 220 by a first pivot pin 245, and a second link 230 is also pivotally attached to the arm pad pan 220 by a second pivot pin 240. The first link 235 comprises a first attachment slot 255 and a link connector slot 265. The second link 230 comprises a second attachment slot 250 and a link connector aperture (not shown). The first link 235 is pivotally attached to the second link 230 by link connector pin 260. In one embodiment, the arm pad pan 220 is indirectly attached to an underlying member (not shown). A first attachment member (not shown) attaches the first link 235 to the underlying member and is positioned in the first link attachment slot 255 and within the first pad pan slot 225. A second attachment member (not shown) likewise attaches the second link 230 to the underlying member and is positioned in the second link attachment slot 250 and within the second pan pad slot 223. Relative to an underlying member (not shown), FIG. 2B shows a pad 308 in a middle position, FIG. 3A shows the pad 308 in a right position, and FIG. 3B shows the pad 308 in a rightmost position. In comparison to arc shaped slots 325, 323 (see, e.g., FIGS. 6A and 12A), in one embodiment, the linearity of slots 225, 223 leads to suboptimal lateral movement of the pad, in part due to contact between the slots and link attachment members because of insufficient clearance. Other embodiments comprise one or more linear slots.

Figure 5:
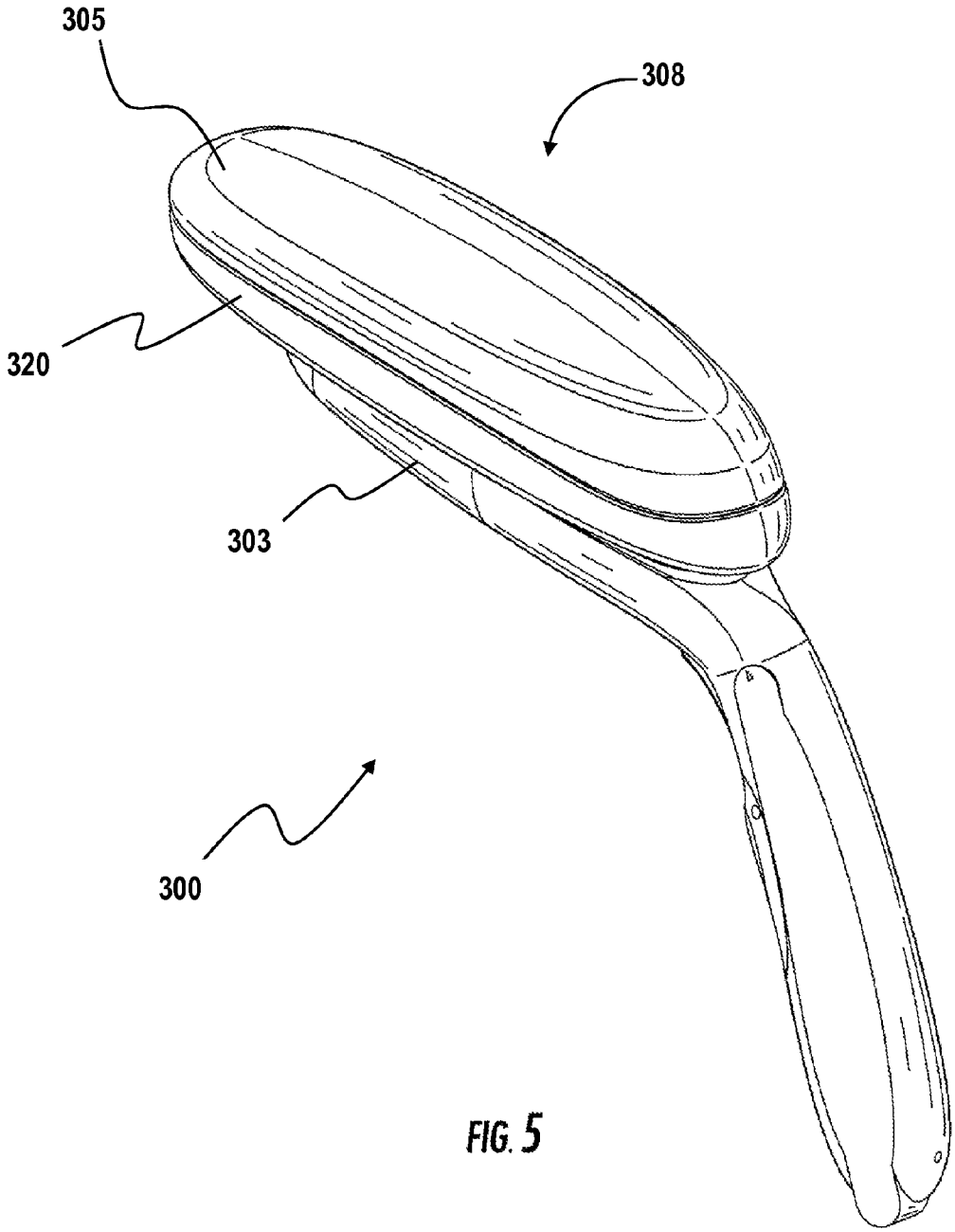
FIG. 5 shows a perspective view of one illustrative embodiment of an armrest assembly.
Figure 11:
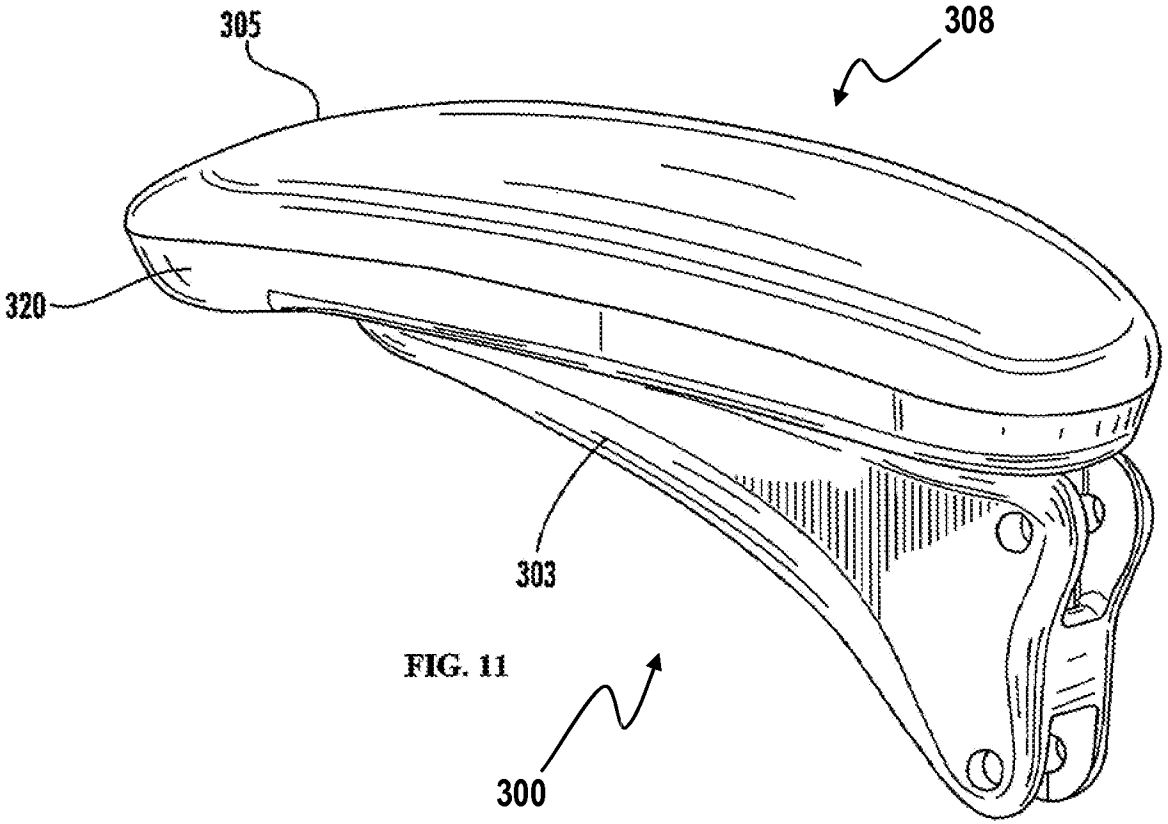
FIG. 11 shows a perspective view of another illustrative embodiment of an armrest assembly.

Turning to another embodiment, FIG. 5 shows a right handed armrest assembly 300. The armrest assembly comprises a pad 308 and an armrest base 303. The pad 308 comprises a pad cover 305 directly attached to a pad pan 320, which in turn is indirectly attached to the armrest base 303. As will be explained in further detail below, the pad 308 is capable of moving laterally as well as forward and backward relative to the armrest base 303. FIG. 11 shows another embodiment of a right handed armrest assembly 300 likewise comprising a pad cover 305 directly attached to a pad pan 320, which in turn is indirectly attached to an armrest base 303. The pad 308 is capable of lateral movement relative to the armrest base 303.

Figure 6A:
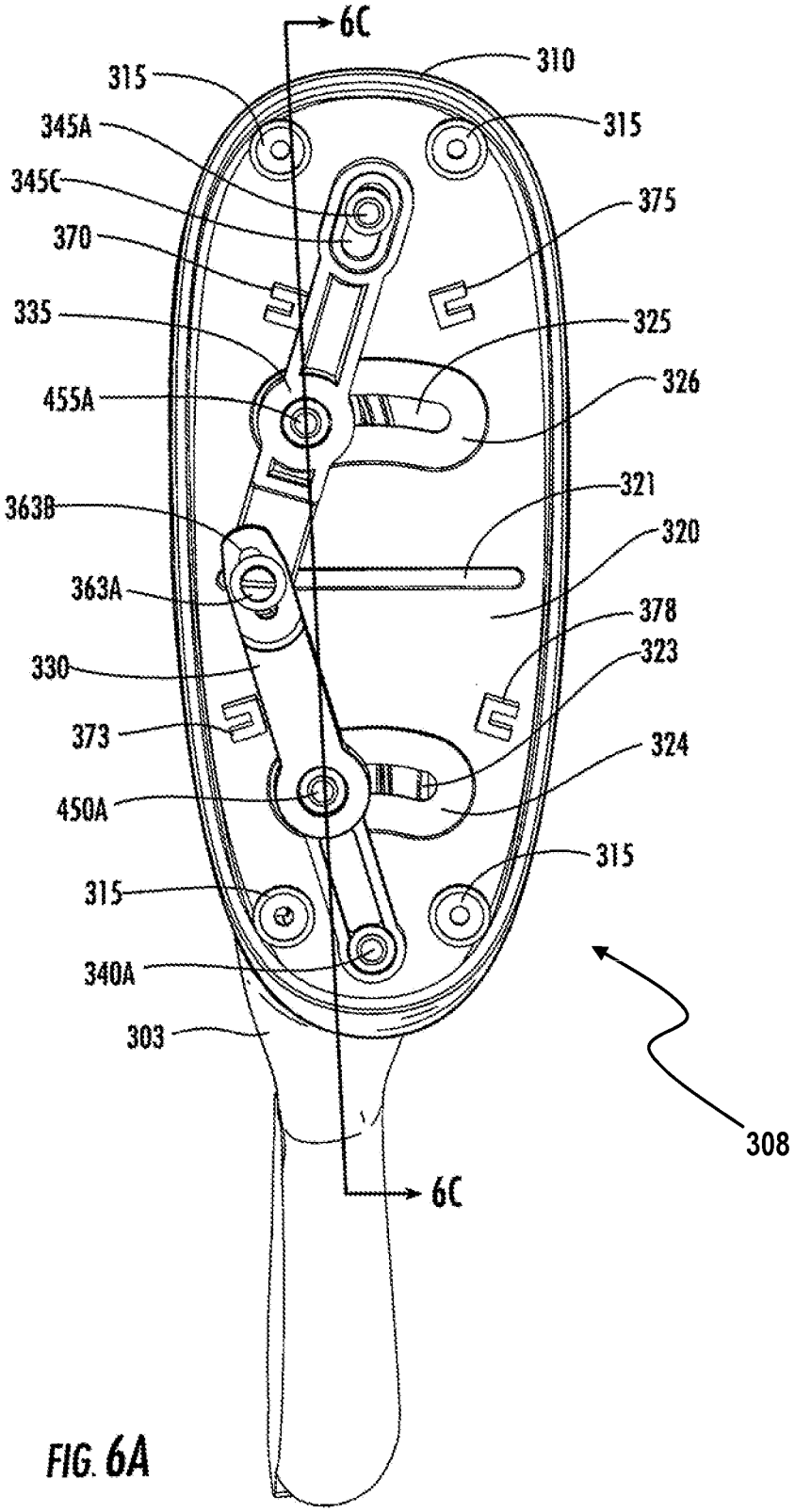
FIG. 6A shows a top elevation view of the armrest assembly of FIG. 5 with the pad cover removed.

Returning to one embodiment shown in FIG. 5, FIG. 6A shows the pad pan 320 with the pad cover 305 removed. When the armrest 300 is in use, the pad cover 305 is attached to the pad pan 320 by fasteners (not shown) that mate with pad cover-pan attachment bores 315. The pad pan 320 comprises a pad pan ring 310 that encircles the circumference of the pad pan 320 and, in one embodiment, provides support for the pad cover 305.

FIG. 6A is a top view of the pad pan 320 in its rightmost position. The shape of pad pan 320 is one of many that may be effectively employed in varying embodiments. At the top of FIG. 6A is the front of the pad pan 320, and at the bottom, near armrest base 303, is the rear of the pad pan 320. One embodiment comprises a first link 335 and a second link 330. In one embodiment, a link is preferably comprised of a rigid material, such as 20% glass-filled nylon. One embodiment of a link is an elongated, unitary member. Another link embodiment is an elongated member comprising a bend (see FIG. 12A), the angle of which may differ from embodiment to embodiment. In one embodiment, the first link 335 and the second link 330 are pivotally attached by any pivotal attachment means known in the art. In another embodiment, the first link 335 and the second link 330 are not only pivotally attached to each other; each link is also pivotally attached to the pad pan 320.

Figure 6B:
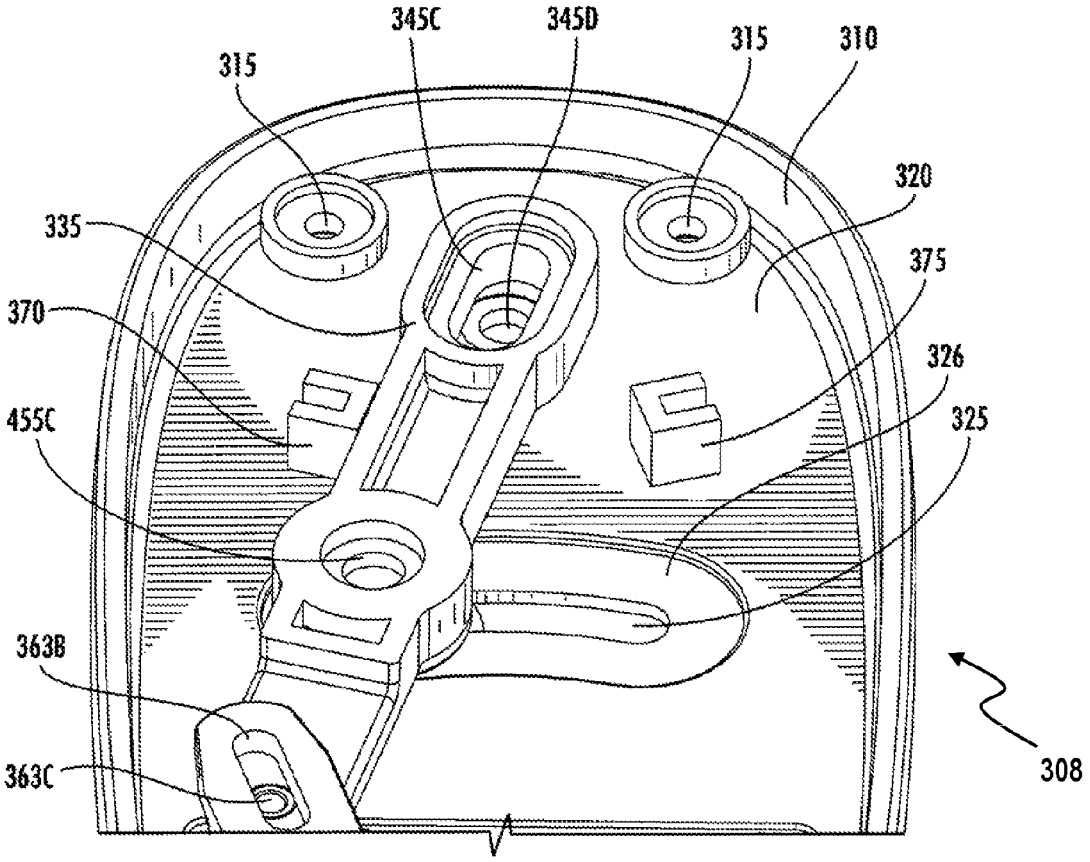
FIG. 6B shows a perspective view of the armrest assembly of FIG. 5 with the pad cover removed.
Figure 6C:
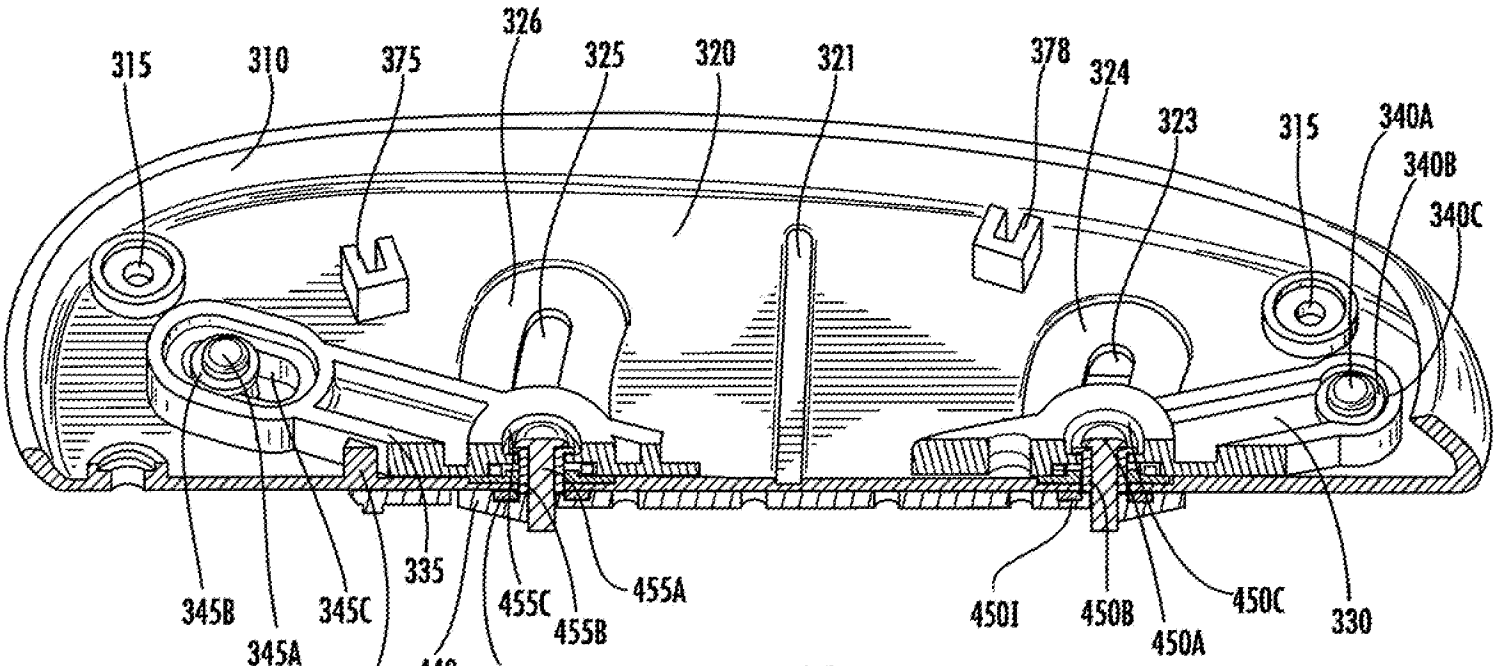
FIG. 6C shows a perspective view of a section of FIG. 6A.

In one embodiment, a first link 335 and a second link 330 are pivotally attached. As shown in FIGS. 6A, 6B, and 6C, the first link 335 comprises a first link pivot slot 345C, and the second link 330 comprises a second link pivot aperture 340C. A first pivoting attachment member 345A and spacer 345B are fixedly attached to the pad pan 320 through a first link pivot slot 345C and a first link-pan bore 345D (see FIG. 6B). The first link 335 is pivotable about the first pivoting attachment member 345A. Similarly, a second pivoting attachment member 340A and spacer 340B (see FIG. 6C) are fixedly attached to the pad pan 320 through a second link pivot aperture 340C and a second link-pan bore (not shown). Hence, the second link 330 is likewise pivotable about the second pivoting attachment member 340A. Although, in this embodiment, the aperture of the first link pivot slot 345C is elliptic while the aperture of the second link pivot aperture 340C is annular, in other embodiments the configuration of the pivot apertures are reversed.

In one embodiment, a first link 335 and a second link 330 cooperate in tandem. As shown in FIGS. 6A and 6B, the rear end of the first link 335 comprises a link connector aperture 363C, the front end of the second link 330 comprises a link connector slot 363B, and the first link 335 and second link 330 are pivotally attached by a link connecting member 363A. In one embodiment, the link connecting member 363A is a pin. In one embodiment, when the pad pan 320 is moved laterally relative to the armrest base 303, the pivotal attachment of the first link 335 and the second link 330 transmits the pivotal motion of links 335, 330 about pivoting attachment members 345A, 340A, respectively, thereby enabling the links 335, 330 to cooperate in tandem.

Returning to FIG. 6A, in one embodiment, a pad 308 is laterally movable. A pad pan 320 comprises a first slot 325 and a second slot 323. As will be explained in further detail below, a first link 335 is attached to a platform 440 (see FIGS. 8A and 8B) through the first slot 325 of pad pan 320 by a first link-platform attachment member 455A. Likewise, a second link 330 is also attached to the platform 440 through the second slot 323 of pad pan 320 by a second link-platform attachment member 450A. In this embodiment, the first slot 325 and second slot 323 are holes through the pad pan 320 that provide clearance for the movement of the link-platform attachment members 455A and 450A, respectively, within slots 325,323. As the pad 308 is moved from the left to the right, the links 335, 330 rotate about link-platform attachment members 455A, 450A, which are stationary with respect to the platform 440. The shape and location of slots 325, 323, i.e., the clearance needed by the link-platform attachment members 455A, 450A as they move laterally through the pad pan 320, are dictated by: the length of links 335, 330; the position of each links' 335, 330 respective pivotal attachments 345A, 340A to the pad pan 320; the points 363B, 363C along the links 335, 330 at which they are pivotally attached to each other; and the attachment point 455A, 450A along each link 335, 330 to the platform 440. In other words, as the pad 308 is moved laterally, regardless of the shape of slots 325, 323, the configuration of the links 335, 330 and their attachments are determinative of the limited motion the pad pan 320 may take with respect to the armrest base 303. The slots 325, 323 merely serve as a clearance for the positions where the links 335, 330, cooperating in tandem and comprising link-platform attachment members 455A, 450A, would otherwise intersect the pad pan 320 as the pad pan 320 is moved from left to right with respect to the armrest base 303. Hence, in one embodiment, the first link 335, which comprises the first link-platform attachment member 455A, is substantially free of contact within the first slot 325 at all lateral positions between its leftmost and rightmost positions, and the same is true for the second link 330 with respect to the second slot 323. Furthermore, the first link 335 being substantially free of contact within the first slot 325 signifies that, for example, while an attachment member 455A or its spacer 455B may incidentally contact the front and rear edges of the first slot 325, the slot 325 itself it not guiding the movement of the pad pan 320, and the same is true for the second link 330 with respect to the second slot 323. In embodiments in which the pad 308 is movable laterally, the user is able to place the pad 308 in an ergonomic position better suited to his or her needs.

In some embodiments, the lateral motion of a pad 308 is limited in range. As shown in FIGS. 6A, 6D, 7A, and 7B, in one embodiment, a pad pan 320 comprises a first inner link stop 370 and a first outer link stop 375 (see FIGS. 6A and 6B). Stops 370, 375 limit the range of pivotal motion of a first link 335, which is pivotally attached to the pad pan 320. The pad pan 320 further comprises a second inner link stop 373 and a second outer link stop 378 (see FIG. 6A). Stops 373, 378 likewise limit the range of pivotal motion of a second link 330, which is also pivotally attached to the pad pan 320. By limiting the range of motion of the links 335, 330, the stops 370, 373, 375, 378 also limit the range of lateral motion of the pad pan 320 relative to an armrest base 303. When the pad 308 is in its rightmost position links 335, 330 abut the inner link stops 370, 373 and when the pad 308 is in its leftmost position the links 335, 330 abut the outer link stops 375, 378. This reduces strain on the links 335, 330, which enhances their durability.

Figure 6D:
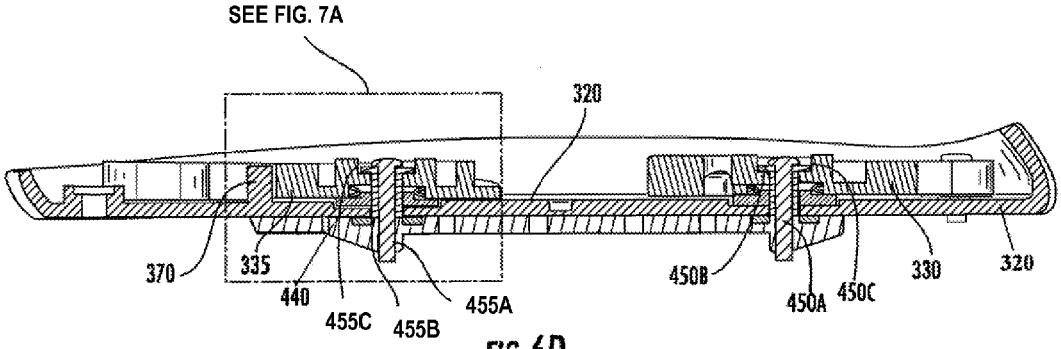
FIG. 6D shows a side elevation view of a section of FIG. 6A.
Figure 7A:
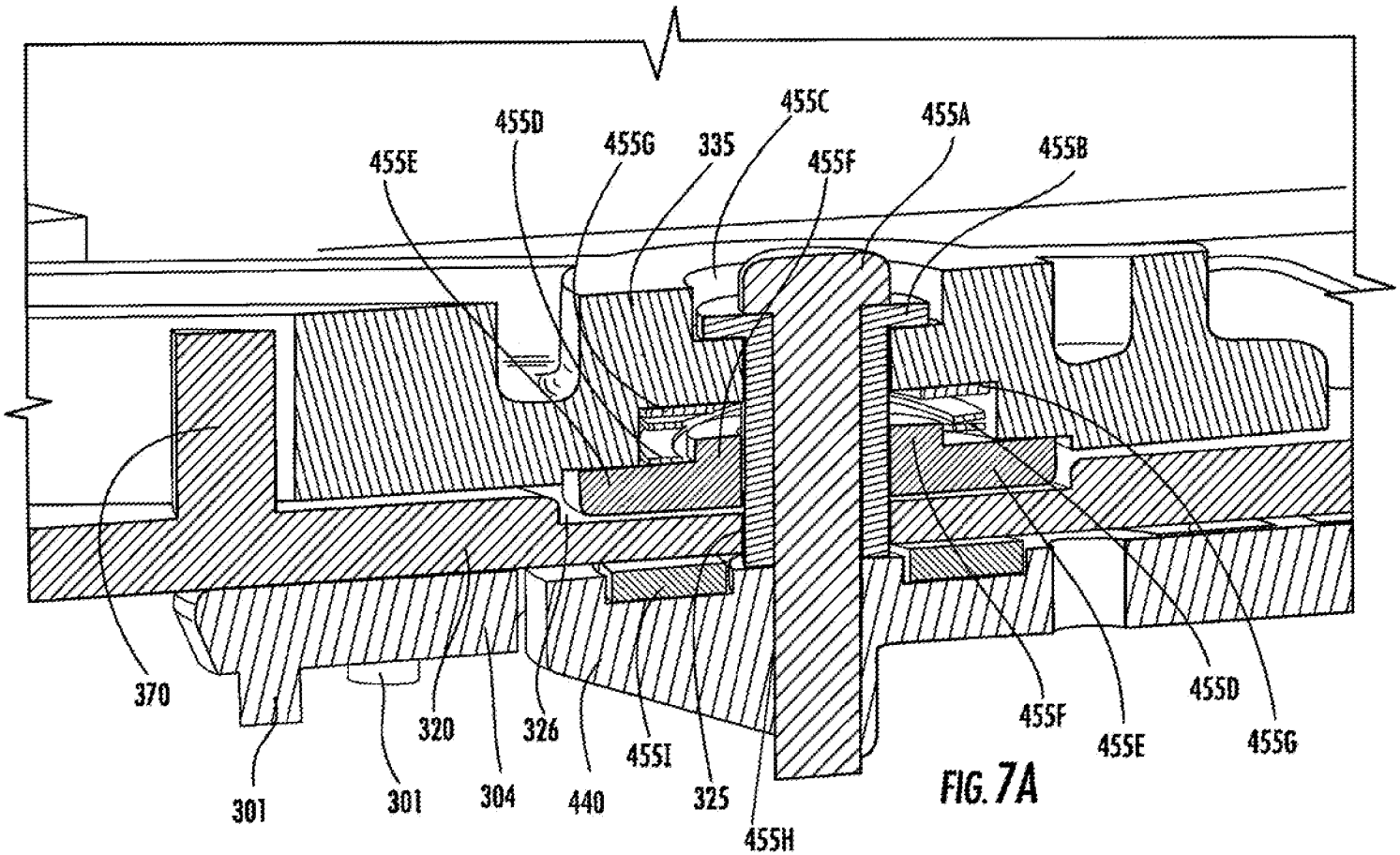
FIG. 7A shows a perspective view of a detail of FIG. 6D.
Figure 7B:
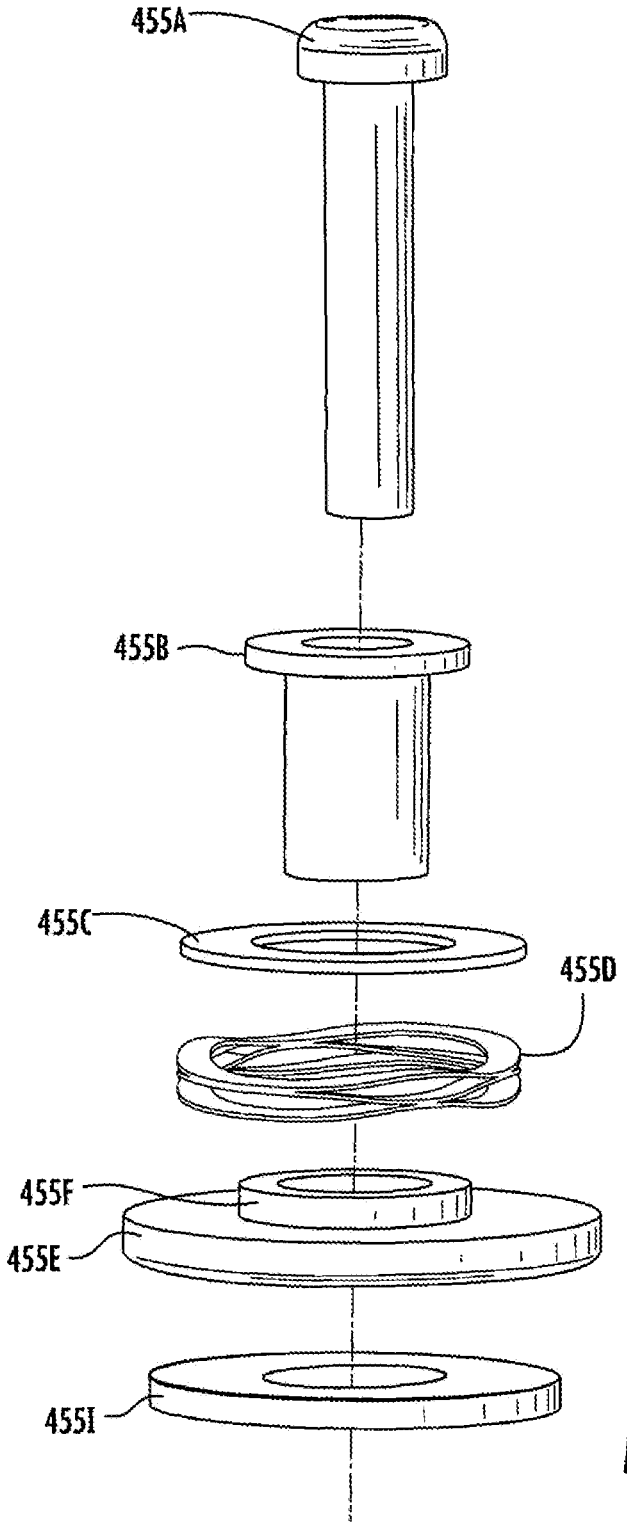
FIG. 7B shows an exploded view of some components shown in FIG. 7A.

Friction may also play a role in regulating the lateral motion of a pad pan 320. In one embodiment, as shown in FIG. 6A, the pad pan 320 comprises a first recess 326 that is offset around a first slot 325 and a second recess 324 that is offset around a second slot 323. In another embodiment, a middle recess 321 provides non-guiding clearance for the movement of link connecting member 363A. In yet another embodiment, a middle slot 321 permits the link connecting member 363A to attach to an underlying friction inducing object. Turning to FIGS. 6D and 7A, in one embodiment, the first link 335 comprises a first link attachment aperture 455C through which a first link-platform attachment member 455A and a spacer 455B are positioned. The first link-platform attachment member 455A and spacer 455B are also positioned within first slot 325 (see FIGS. 6C and 7A), and are axially aligned with shim 455G, wave spring 455D, bushing 455E, and first platform washer 455I (see FIG. 7B). Bushing 455E and washer 455I preferably comprise polyoxymethylene. Referring to FIGS. 7A and 7B, the bushing 455E comprises a shoulder 455F having an inner diameter equal to that of the bushing 455E but a lesser outer diameter. The outer diameter of the bushing shoulder 455F is less than or equal to the inner diameter of wave spring 455D. Hence, in one embodiment, the wave spring 455D may fit around the bushing shoulder 455F. The first link-platform attachment member 455A and spacer 455B are positioned through apertures of bushing 455E, shim 455G, and wave spring 455D, which are positioned in an annular cavity (not labeled) within the underside of the first link 335. When mated to the first link-platform attachment bore 455H (see FIG. 8), the first link-platform attachment member 455A exerts a downward force on spacer 455B, which transmits the force to an annular flange (not labeled) of the first link 335. The wave spring 455D, on the other hand, exerts an upward biasing force on shim 455G, which transmits the force to the annular flange of the first link 335. The wave spring 455D also exerts a downward biasing force on bushing 455E, which transmits the force to the first recess 326. The interaction of the underside of bushing 455E and the first recess 326 creates friction that resists the lateral movement of the pad pan 320 relative to the armrest base 303. The second link-platform attachment member 450A and accompanying components are similarly arranged mutatis mutandis.

In one embodiment, the spacer 455B is dimensioned such that the maximally tightened position of the first link-platform attachment member 455A permits the wave spring 455D to compensate for variations in the dimensions of adjoining components. In other embodiments, when the first link 335 is biased downward, or when the first link-platform attachment member 455A is sufficiently tightened, the first link 335 may contact the bushing 455E directly, bypassing shim 455G and wave spring 455D, which may further increase the friction force between the bushing 455E and the first recess 326. The first platform washer 455I may provide additional friction with the underside of pad pan 320.

Figure 8A:
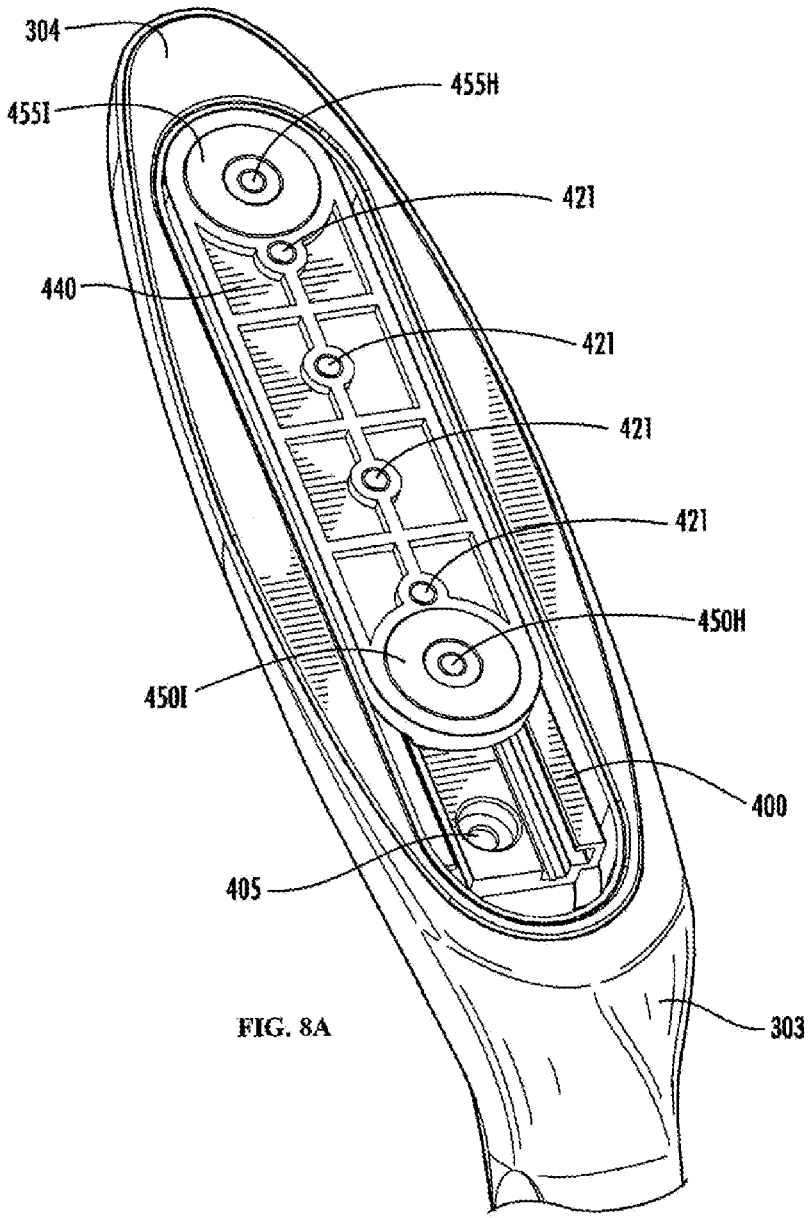
FIG. 8A shows a perspective view of the armrest assembly of FIG. 5 with the pad removed.

In one embodiment, a pad 308 is capable of moving forwards and backwards. Turning to FIG. 8A, which shows one embodiment with the pad 308 removed, a horizontal base plate 304 is fixedly attached to an armrest base 303. A sliding platform 440 is fixedly attached to one or more sliding carriages 420 (see FIG. 9A), which in turn are slidably engaged to an extruded rail 400. The sliding platform 440 comprises a first link-platform attachment bore 455H, a first platform washer 455I, a second link-platform attachment bore 450H, a second platform washer 450I, and one or more platform-carriage attachment apertures 421. Referring to FIGS. 6D and 8A, one embodiment comprises a first link 335 and a second link 330, each of which is pivotally attached to a pad pan 320. The first link 335 comprises a first link-platform attachment member 455A that mates with the first link-platform attachment bore 455H. Likewise, the second link 330 comprises a second link-platform attachment member 450A that mates with the second link-platform attachment bore 450H. The slidable engagement between the extruded rail 400 and the sliding carriage 420 permits the sliding carriage 420 to move forward and backward with respect to an armrest base 303. Because the links 335, 330 are attached to the pad pan 320 as well as the sliding platform 440, which in turn is attached to the sliding carriage 420, the ability of the sliding carriage 420 to move forward and backward is shared by the sliding platform 440, the links 335, 330, and the pad pan 320. In embodiments in which the pad 308 is movable laterally as well as forward and backward, the user is better able to place the pad 308 in an ergonomic position.

In one embodiment, as shown in FIG. 7A, the horizontal base plate 304 contacts the underside of pad pan 320 and induces a resistive friction force. Unlike, for example, the resistive engagement between a bushing 455E and recess 326, which creates a frictional force resisting lateral movement, the interaction between the horizontal plate 304 (as well as, in one embodiment, platform washers 455I, 450I) and the underside of the pad pan 320 creates a frictional force resisting all horizontal movement of the pad 308 with respect to the armrest base 303, i.e., both lateral movement and forward and backward movement. In some embodiments, the weight of a user's arm on a pad 308 increases the resistance to horizontal motion created by the horizontal base plate 304 and/or the platform washers 455I, 450I and thereby substantially immobilizes the pad pan 320.

Figure 8B:
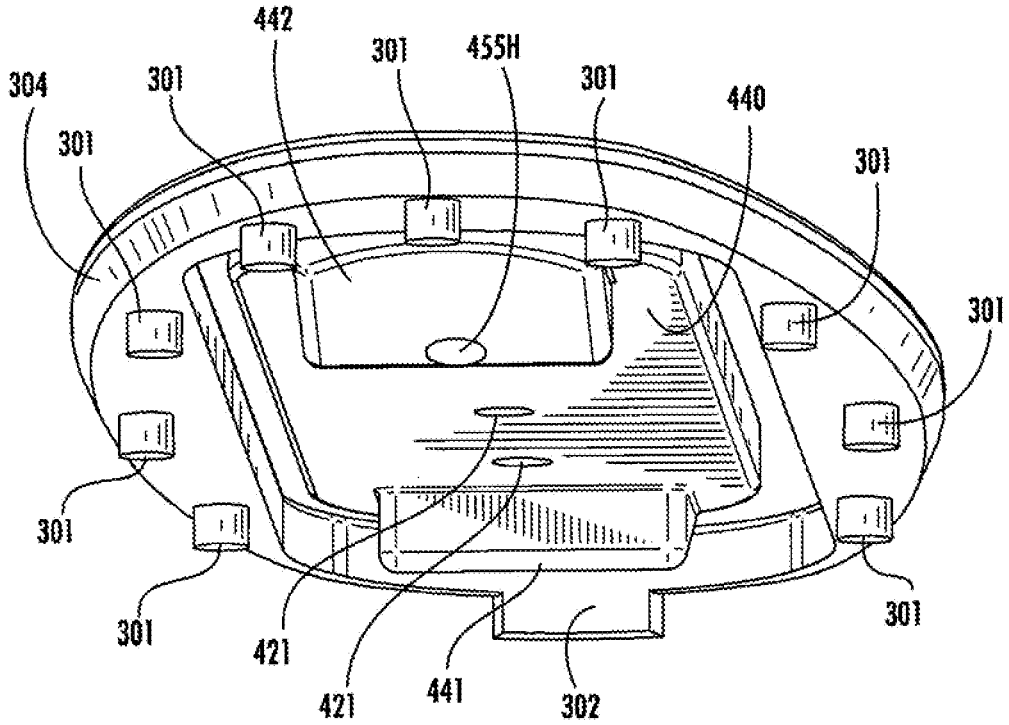
FIG. 8B shows a bottom perspective view of a sliding platform and horizontal base plate.

Turning to FIG. 8B, in one embodiment, a platform 440 comprises a first link-platform attachment bore 455H, a second link-platform attachment bore (not shown), one or more platform-carriage attachment apertures 421, a first restraining member 442 and a second restraining member 441. Restraining members 442, 441 abut the front and rear ends, respectively, of an underlying sliding carriage 420. In one embodiment, restraining members 442, 441 relieve sheering tension from the platform-carriage attachment members (not shown) as the platform 440 and carriage 420 are moved forwards and backwards. A horizontal base plate 304, which is a separate component from the sliding platform 440, comprises one or more plate-base attachment members 301 and a plate lip 302 that mates with a corresponding plate lip notch (not shown) in the armrest base 303.

Figure 9A:
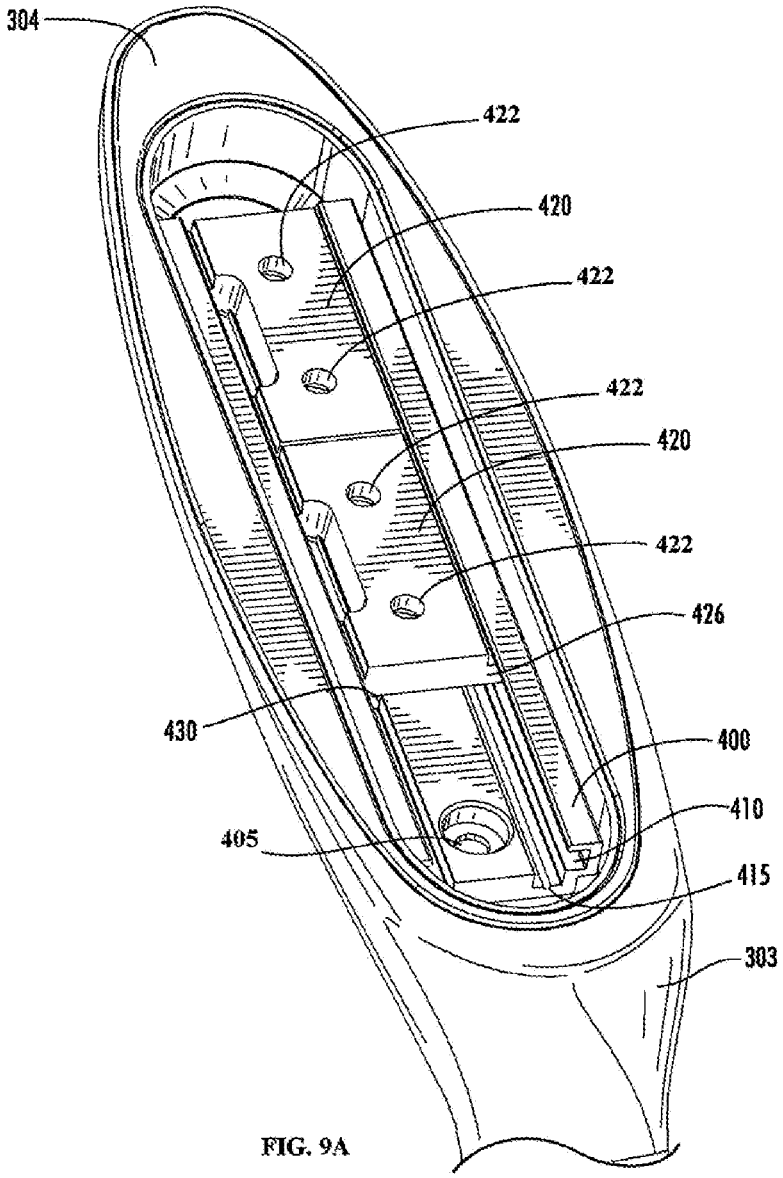
FIG. 9A shows a perspective view of the armrest assembly of FIG. 5 with the sliding platform and pad removed.
Figure 9B:
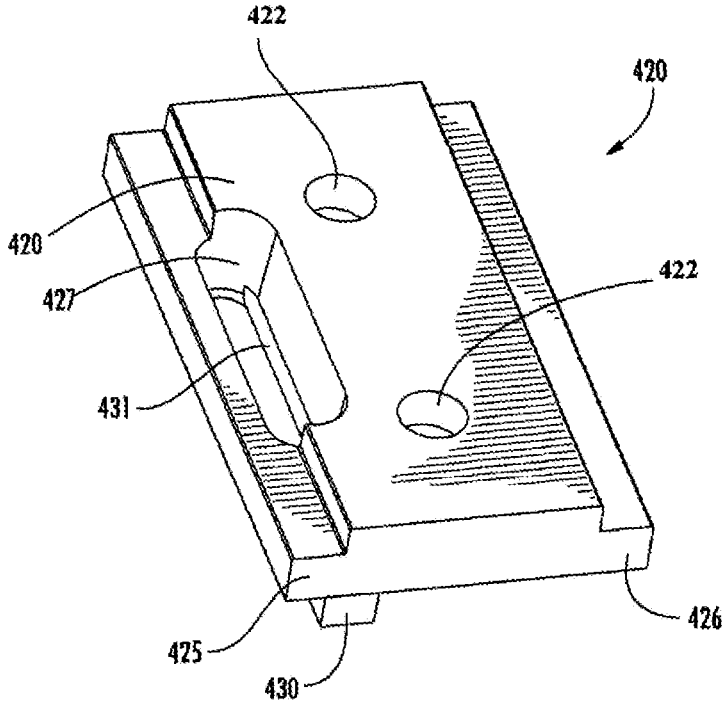
FIG. 9B shows a top perspective view of a carriage.
Figure 9C:
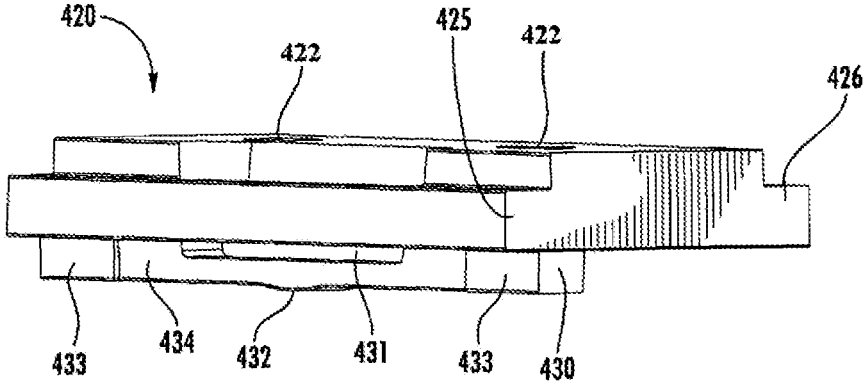
FIG. 9C shows a side perspective view of a carriage.

Referring now to FIGS. 9A, 9B, and 9C, in one embodiment, one or more carriages 420 are slidably engaged to an extruded rail 400, which in turn is fixedly attached to an armrest base 303. In one embodiment, a carriage 420 preferably comprises polytetrafluoroethylene or derivates thereof. The carriage 420 comprises one or more platform-carriage attachment bores 422, an inner horizontal bar 426, an outer horizontal bar 425, and at least one vertical bar 430. In one embodiment, inner horizontal bar 425 comprises an aperture 427. In one embodiment, vertical bar 430 comprises an aperture 431, end sections 433, a midsection 434, and protuberance 432. The vertical bar midsection 434 is narrower than end sections 433. Narrowed midsection 434 and protuberance 432 help to minimize contact between, and therefore friction from, the carriage 420 and the extruded rail 400. In another embodiment, a horizontal bar comprises a protuberance.

Figure 10B:
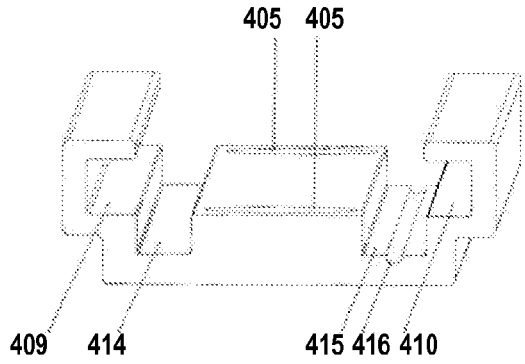
FIG. 10B shows a side perspective view of an extruded rail.
Figure 10A:
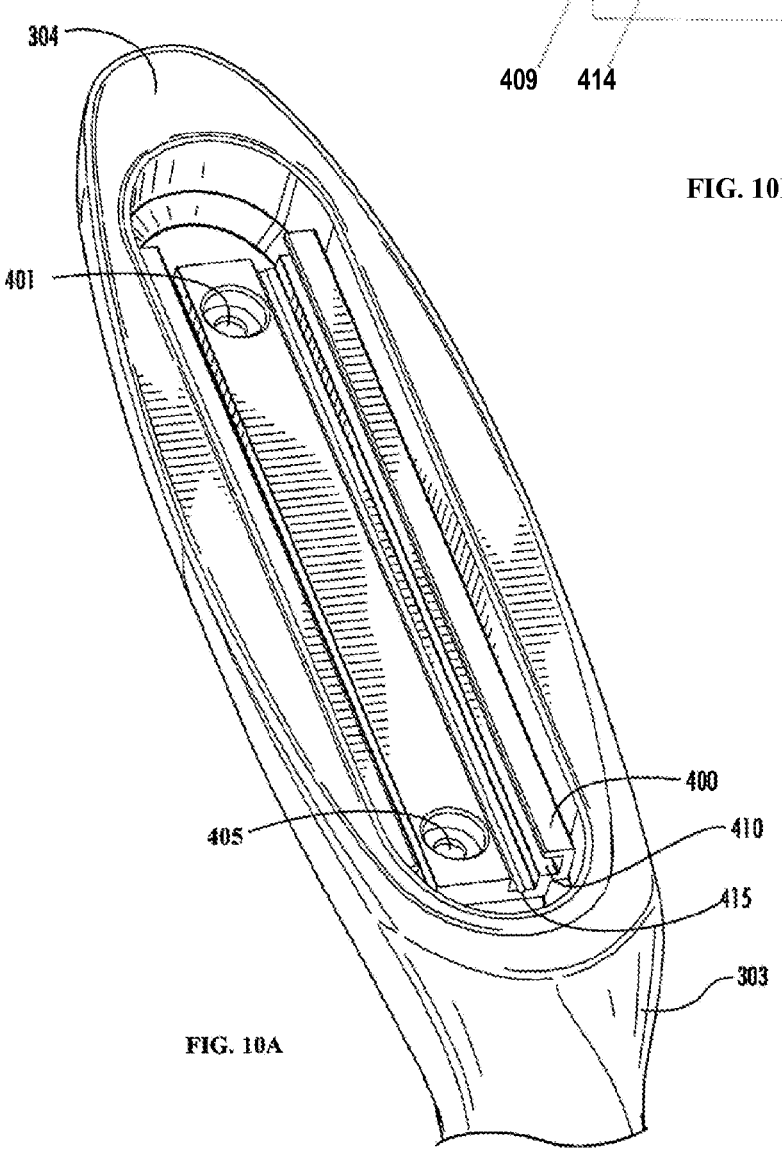
FIG. 10A shows a perspective view of the armrest assembly of FIG. 5 with carriages, sliding platform, and pad removed.

In one embodiment, as shown in FIGS. 10A and 10B, a rail-base attachment member (not shown) mates with a rail-base attachment aperture 405 and a rail-base attachment bore (not shown) in order to fixedly attach an extruded rail 400 to an armrest base 303. The extruded rail 400 comprises one or more rail-base attachment apertures 405, an inner C-shaped channel 409, an outer C-shaped channel 410, an inner U-shaped channel 414, an outer U-shaped channel 415, and one or more grooves 416. In one embodiment, the carriage horizontal bars 425, 426 engage to the rail C-shaped channels 409, 410, and the carriage vertical bar 430 engages to the rail U-shaped channel 414. A groove 416 in the outer U-shaped channel 415 may have several uses. As a non-limiting example, a U-shaped channel 415 comprising a groove 416 may serve as a visual marker that a carriage 420, comprising a single vertical bar 430, should have the vertical bar 430 placed in the U-shaped channel 414 in which the groove 416 is absent. Alternatively, when a vertical bar 430 is placed in a U-shaped channel 415 comprising a groove 416, Applicants speculate, without being bound by theory, that the groove 416 may reduce the surface contact between the bottom of the U-shaped channel 415 and the bottom of a vertical bar 430, thereby reducing the friction created by their relative movement.

In one embodiment, a sliding carriage 420 comprises at least one horizontal bar or, alternatively, at least one vertical bar, and a extruded rail 400 comprises at least one corresponding C-shaped or, alternatively, U-shaped channel. In another embodiment, an extruded rail 400 is arc shaped as opposed to linear such that the forward and backward motion of a sliding carriage 420 follows a curved path.

Figure 12A:
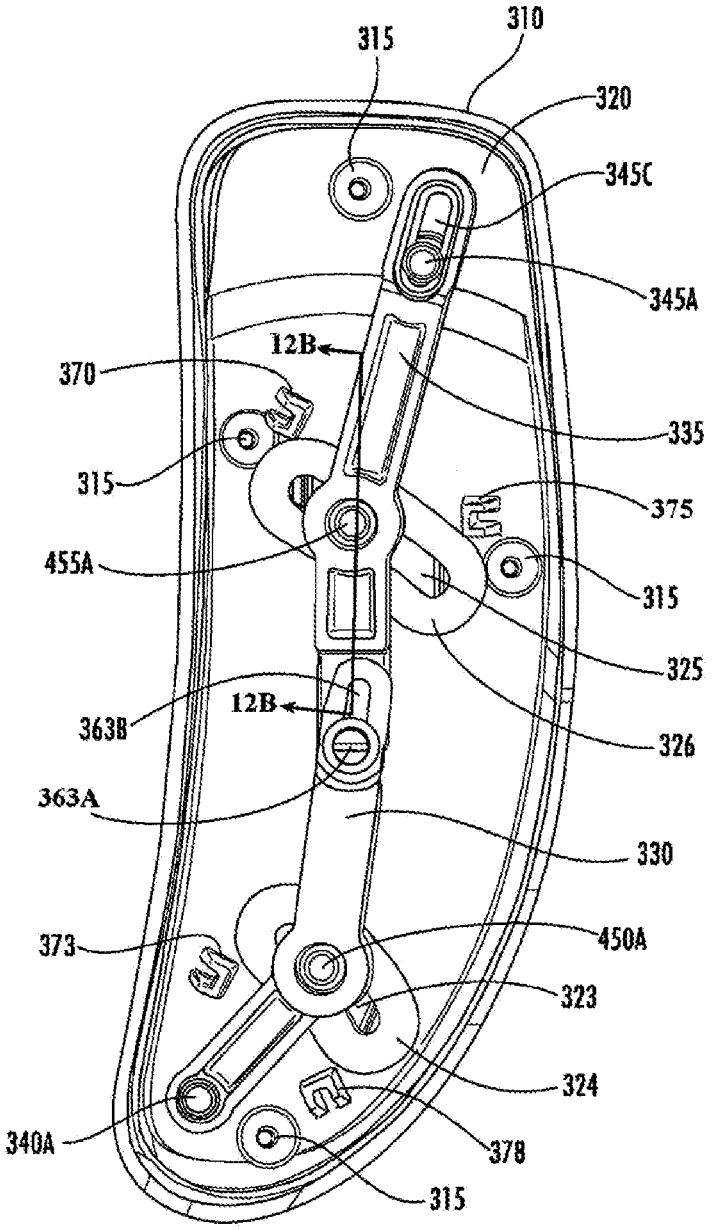
FIG. 12A shows a top elevation view of the armrest assembly of FIG. 11 with the pad cover removed.
Figure 12B:
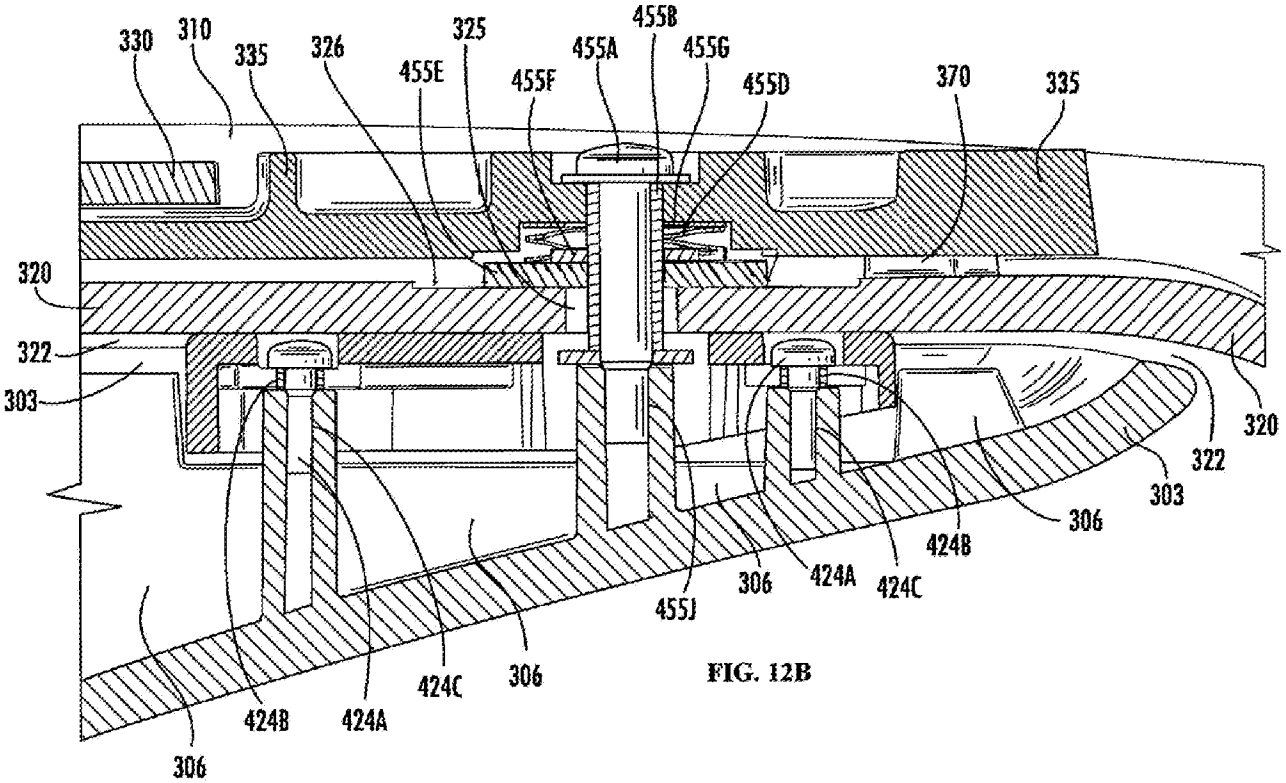
FIG. 12B shows a side elevation view of a section of FIG. 12A.

In one embodiment, FIG. 11 shows a right-handed armrest assembly 300 comprising a pad 308 and an armrest base 303. The pad 308 comprises a pad cover 305 directly attached to a pad pan 320. The pad pan 320 is indirectly attached to the armrest base 303. In one embodiment, the pad 308 is laterally movable with respect to the armrest base 303. Turning to FIGS. 12A and 12B, in one embodiment, a pad pan 320 comprises a first slot 325 and a second slot 326. The underside of the pad pan 320 curves downward near its front. In one embodiment, a pad pan 320 comprises one or more pad cover-pan attachment bores 315, a first inner link stop 370, a first outer link stop 375, a second inner link stop 373, a second outer link stop 378, a first slot 325 surrounded by an offset first recess 326, a second slot 323 surrounded by an offset second recess 324, a first link-pan aperture (not shown), and a second link-pan aperture (not shown). In one embodiment, a first link 335 is pivotally attached to a pad pan 320, a second link 330 is pivotally attached to the pad pan 320, and the first link 335 is pivotally attached to the second link 330. The first link 335, an embodiment of which is an elongated, unitary member, comprises: a first link pivot slot 345C, a first link-platform attachment member 455A, a first link attachment aperture 455C, a bend, and a link connector aperture (not shown). The second link 330, an embodiment of which is an elongated, unitary member, comprises: a link connector slot 363B, a second link-platform attachment member 450A, a second link attachment aperture (not shown), a bend, and a second link pivot aperture (not shown). The stops 370, 373, 375, 378 limit the range of motion of links 335, 330.

Figure 13:
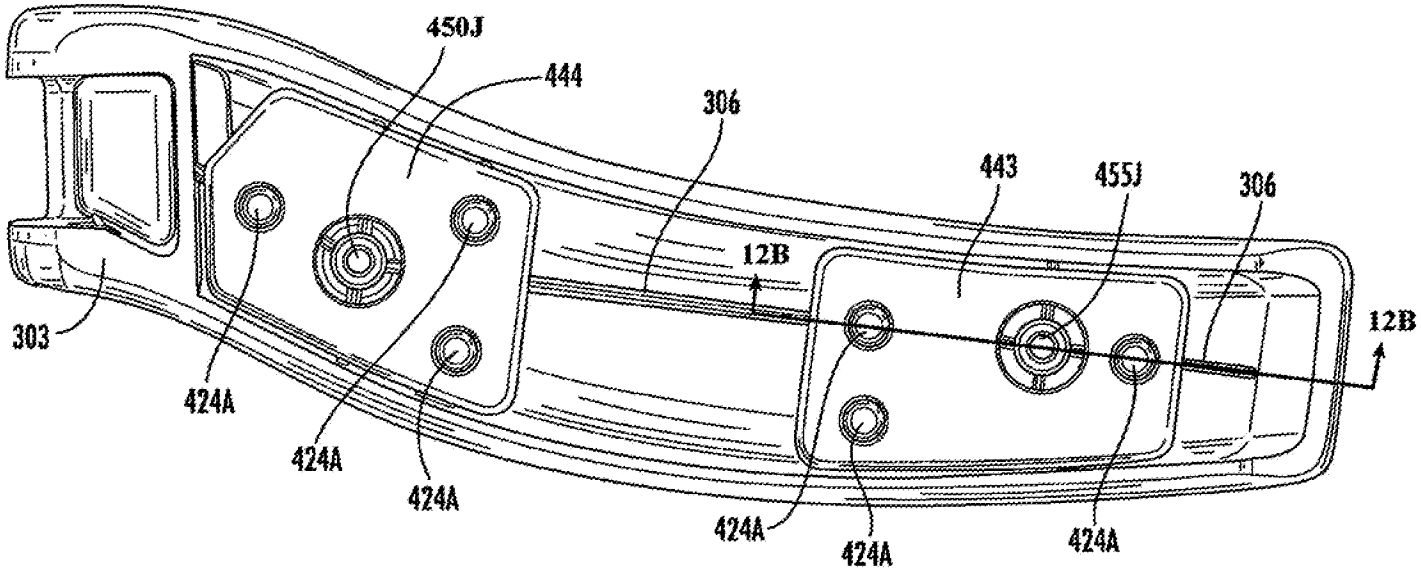
FIG. 13 shows a top elevation view of the armrest assembly of FIG. 11 with the pad removed.

As shown in FIGS. 12B and 13, in one embodiment, an armrest base 303 comprises: a vertical base plate 306, which supports and stabilizes one or more platforms 443, 444, a first link-base attachment bore 455J, a second link-base attachment bore 450J, and one or more platform-base attachment bores 424C. A first platform 443 comprises a platform-base attachment aperture 424B. The first platform 443 is fixedly attached to the armrest base 303 by a platform-base attachment member 424A that mates with the platform-base attachment aperture 424B and the platform-base attachment bore 424C. The second platform 444 is fixedly attached to the armrest base 303 in the same manner. In one embodiment, a pad pan 320 does not contact the armrest base 303 leaving a gap of space 322 between them. The platforms 443, 444 and the underside of pad pan 320, on the other hand, do contact and their interaction creates friction that resists the lateral motion of the pad 308 relative to the armrest base 303. In one embodiment, a spacer 455B prevents a first link-platform attachment member 455A from being tightened beyond a certain point, which, in some embodiments, may allow the first link 335 to directly contact a bushing 455E.

Descriptions of some embodiments have been presented for purposes of illustration only. It is not intended to be exhaustive or to limit the invention to the precise form disclosed, and modifications and variations are possible in light of the above teachings or may be acquired from practice of the invention. The invention may be modified and practiced in different but equivalent manners that will be apparent to those skilled in the chair arm art having the benefit of the teachings of this disclosure. The embodiments were chosen and described in order to explain the principles of the invention and its practical application to enable one skilled in the art to utilize the invention in various embodiments and with various modifications as are suited to the particular use contemplated. It is therefore evident that the particular embodiments disclosed above may be altered or modified and all such variations are considered within the scope and spirit of the invention. It is intended that the scope of the invention be defined solely by the claims and their equivalents.

PARTS LIST

200 arm pad assembly
205 arm pad covering
210 arm pad ring
220 arm pad pan
223 second slot
225 first slot
230 second link
235 first link
240 second pivot pin
245 first pivot pin
250 second attachment slot
255 first attachment slot
260 link connector pin
265 link connector slot
270 first inner link stop
275 first outer link stop
280 lock slide
283 lock slide pin
285 link lock release button
287 button pin
290 actuating crank
293 crank pivot
295 lock slide fingers
300 armrest assembly
301 plate-base attachment member
302 plate lip
303 armrest base
304 horizontal base plate
305 pad cover
306 vertical base plate
308 pad
310 pad pan ring
315 pad cover-pan attachment bore
320 pad pan
321 middle recess
322 gap between pad pan and armrest base
323 second slot
324 second recess
325 first slot
326 first recess
330 second link
335 first link
340A second pivoting attachment member
340B spacer
340C second link pivot aperture
345A first pivoting attachment member
345B spacer
345C first link pivot slot
345D first link-pan aperture
363A link connecting member
363B link connector slot
363C link connector aperture
370 first inner link stop
373 second inner link stop
375 first outer link stop
378 second outer link stop
400 extruded rail
405 rail-base attachment aperture
409 inner C-shaped channel
410 outer C-shaped channel
414 inner U-shaped channel
415 outer U-shaped channel
416 U-channel grove
420 sliding carriage
421 platform-carriage attachment aperture
422 platform-carriage attachment bore
424A platform-base attachment member
424B platform-base attachment aperture
424C platform-base attachment bore
425 outer horizontal bar
426 inner horizontal bar
427 horizontal bar aperture
430 vertical bar
431 vertical bar aperture
432 protuberance
433 vertical bar end section
434 vertical bar midsection
440 sliding platform
441 second restraining member
442 first restraining member
443 first platform
444 second platform
450A second link-platform attachment member
450B spacer
450C second link attachment aperture
450H second link-platform attachment bore
450I second platform washer
450J second link-base attachment bore
455A first link-platform attachment member
455B spacer
455C first link attachment aperture
455D wave spring
455E bushing
455F bushing shoulder
455G Shim
455H first link-platform attachment bore
455I first platform washer
455J first link-base attachment bore That which is claimed:

1. An armrest comprising:

a pan comprising:

a first slot and a first recess offset around the first slot; and a second slot and a second recess offset around the second slot;

a pan support member;

a first link and a second link cooperatively movable and pivotally attached to each other, each of the first and second links being pivotally attached to the pan;

a first attachment member attaching the first link to the pan support member through the first slot; and a second attachment member attaching the second link to the pan support member through the second slot.

2. The armrest of claim 1, at least one of the first link and the second link comprising at least one aperture.

3. The armrest of claim 2, wherein the at least one aperture is an elliptic aperture.

4. The armrest of claim 2, wherein one of the first link and the second link is pivotally attached to at least one of the pan and the other link about the at least one aperture.

5. The armrest of claim 1, wherein at least one of the first slot and the second slot has an arc shape.

6. The armrest of claim 1, the pan comprising a third recess located between the first recess and the second recess, the pivotal attachment between the first and second links being operable to move within the third recess.

7. The armrest of claim 1, wherein:

the first slot is shaped to provide non-guiding clearance for movement of the first attachment member through the first slot; and the second slot is shaped to provide non-guiding clearance for movement of the second attachment member through the second slot.

8. The armrest of claim 1, each of the first link and the second link having a rightmost position and a leftmost position; and the pan further comprising at least one link stop positioned on the pan to abut one of the first link and the second link at one of the rightmost position and the leftmost position.

9. The armrest of claim 1, the pan support member further comprising a plate in resistive contact with the pan.

10. The armrest of claim 1, further comprising:

at least one bushing in resistive contact with one of the first recess and the second recess; and a biasing member urging the at least one bushing to increase its resistive contact with the recess.

11. The armrest of claim 1, at least one of the first link and the second link having a bend.

12. An armrest comprising:

a pad supported by and movable relative to an underlying object, the pad having first and second slots formed therethrough;

the underlying object including a pad support member having:

a rail longitudinally within the pad support member, the rail defining a longitudinal axis; and at least one carriage slidably engaged with the rail along the longitudinal axis;

a first elongated member pivotally attached to the pad and the underlying object;

a second elongated member pivotally attached to the pad and the underlying object, the first and second elongated members being pivotally attached to each other, each of the first and second elongated members having an attachment member pivotally attaching the first and second elongated members to the underlying object through the respective first and second slots, wherein at least one of the attachment members is operably connected to the at least one carriage to slide the pad in a direction substantially parallel to the longitudinal axis.

13. The armrest of claim 12, the first elongated member having a first elliptically shaped aperture and a second elliptically shaped aperture, the first elongated member being pivotally attached:

to the pad about the first elliptically shaped aperture; and to the second elongated member about the second elliptically shaped aperture.

14. The armrest of claim 12, the first and second slots being shaped to provide non-guiding clearance for movement of the attachment members therethough.

15. The armrest of claim 12, wherein:

at least one of the first and second slots has an arc shape; and the pad further includes:

a first recess offset around the first slot; and a second recess offset around the second slot.

16. An armrest comprising:

a pan comprising a first slot and a second slot;

a pan support member including a rail and at least one carriage slidably engaged with the rail;

a first link and a second link cooperatively movable and pivotally attached to each other, each of the first and second links being pivotally attached to the pan;

a first attachment member attaching the first link to the pan support member through the first slot; and a second attachment member attaching the second link to the pan support member through the second slot, the first and second attachment members being operably connected to the at least one carriage to slide the pan in a forward and a backward direction relative to the pan support member.

17. The armrest of claim 16, the first and second slots being shaped to provide non-guiding clearance for movement of the attachment members therethough.

18. The armrest of claim 16, wherein at least one of the first slot and the second slot has an arc shape.

19. The armrest of claim 16, the pan further comprising:

a first recess offset around the first slot; and a second recess offset around the second slot.

20. The armrest of claim 16, each of the first link and the second link having a rightmost position and a leftmost position; and the pan further comprising at least one link stop positioned on the pan to abut one of the first link and the second link at one of the rightmost position and the leftmost position.

* * * * *